US005367959A

United States Patent [19]

Allen et al.

[11] Patent Number: 5,367,959

[45] Date of Patent: Nov. 29, 1994

[54] LOTTERY TICKET SCRAPINGS CATCHER

[76] Inventors: Reed Allen, 513 Western Ave., Cedarburg, Wis. 53012; Paul J. Juhasz, 2016 N. Cedar Rd., Adell, Wis. 53001

[21] Appl. No.: 966,297

[22] Filed: Oct. 26, 1992

[51] Int. Cl.[5] ..... A47B 85/00; G09F 13/00

[52] U.S. Cl. ..... 108/23; 108/24; 108/25; 108/26; 40/442; 220/908

[58] Field of Search ..... 108/23, 25, 26, 24; 40/442, 564; 232/43.1; 220/908, 23.83

[56] References Cited

U.S. PATENT DOCUMENTS

| | | | |
|---|---|---|---|
| 1,745,164 | 1/1930 | Griffith | 108/23 |
| 1,951,242 | 3/1934 | Gray | 108/23 |
| 3,104,492 | 9/1963 | Banks | 108/23 |
| 3,422,774 | 1/1969 | Hagans | 108/23 |
| 3,442,230 | 5/1969 | Polen | 108/24 |
| 4,073,240 | 2/1978 | Fly | 108/24 |
| 4,593,615 | 6/1986 | Kehl | 220/908 |
| 4,606,576 | 8/1986 | Jones | 108/24 |
| 4,646,382 | 3/1987 | Smith . | |
| 4,654,762 | 3/1987 | Caverick | 108/23 |
| 4,654,923 | 4/1987 | Faciane et al. . | |
| 4,729,490 | 3/1988 | Ziegenbein | 220/908 |
| 4,777,693 | 10/1988 | Diba et al. . | |
| 4,793,061 | 12/1988 | Rizzo, Jr. . | |
| 4,881,291 | 11/1989 | Ellis . | |
| 5,127,720 | 7/1992 | Schultz . | |
| 5,147,056 | 9/1992 | Ma | 232/43.1 |

*Primary Examiner*—Michael J. Milano

*Attorney, Agent, or Firm*—Ryan, Kees & Hohenfeldt

[57] ABSTRACT

A device for use in connection with scraping coatings from lottery tickets. The device includes a base surface for supporting lottery tickets for scraping off said coating therefrom, and a moat surrounding at least a substantial part of the base surface for catching the coatings scraped from the tickets. In one embodiment, an advertising display is mounted on the device, which display may be brought into view only upon use of the device. The display may be brought into view by a light source activated by use of the device in connection with the lottery tickets, such as by a switch activated by depression of the base surface, the light source thus illuminating the display upon closure of the switch. In one embodiment the base surface is pivotally mounted in the housing so that application of pressure on the surface causes one side thereof to be pivoted downwardly, causing closure of the switch.

11 Claims, 3 Drawing Sheets

10
12
14
16
22
32
40
42
43
44
46
48
5

LOTTERY TICKET SCRAPINGS CATCHER

FIELD OF THE INVENTION

This invention relates to a device for supporting lottery tickets of the scratch off type during the removal of the opaque coating applied thereon. More particularly, the invention relates to such a device which incorporates an advertising display that is brought into view by pressure on the lottery ticket supporting surface.

BACKGROUND OF THE INVENTION

The sale of lottery tickets including those of the scratch off type has expanded greatly during recent years. A problem that has been created by such tickets is caused by the fact that the debris from scraping such tickets litters the check out areas of retail outlets that sell such tickets.

It has previously been suggested to provide a device such as a tray to which a scratching device is secured, for example, by a chain and in which a scrapings-receiving slot is provided adjacent to a scraping surface. See, for example, U.S. Pat. No. 5,127,720 issued Jul. 7, 1992.

SUMMARY OF THE INVENTION

An object of the invention is to provide a lottery ticket scratching device which is combined with an advertising display. An important aspect of the invention relates to providing a lottery ticket scratching surface which is movably supported and movement of which activates the advertising display, such as by illuminating a light for lighting the display.

In accordance with a related aspect of the invention the supporting surface carries a switch for turning said illuminating light on and off. In accordance with a further aspect of a preferred embodiment of the invention, the supporting surface and the advertising device may be formed all of one piece. In accordance with yet a further aspect of the invention, the device can be supported for pivoting on a supporting surface such as a counter or tabletop so that one side of the supporting surface pivots downwardly to activate a switch to turn on the illuminating light during use of the device.

In accordance with a related aspect of the invention, the activating switch can be carried by the depressible portion of the surface so that the switch is turned on when the surface is depressed. In accordance with yet a further aspect of the invention, a lottery ticket scratching device can be attached to the apparatus of this invention by means of a cord or chain. In accordance with yet a further aspect of the invention, means such as an indented area adjacent to the supporting surface is provided to receive residue from scratching off of coatings from the lottery tickets. In accordance with a further embodiment of the invention a slot leading to a waste receptacle can be provided for disposal of both the scrapings and worthless tickets.

DESCRIPTION OF THE DRAWING

The invention will be further set forth in the following detailed description and accompanying drawing figures wherein.

DETAILED DESCRIPTION

Figure 2:
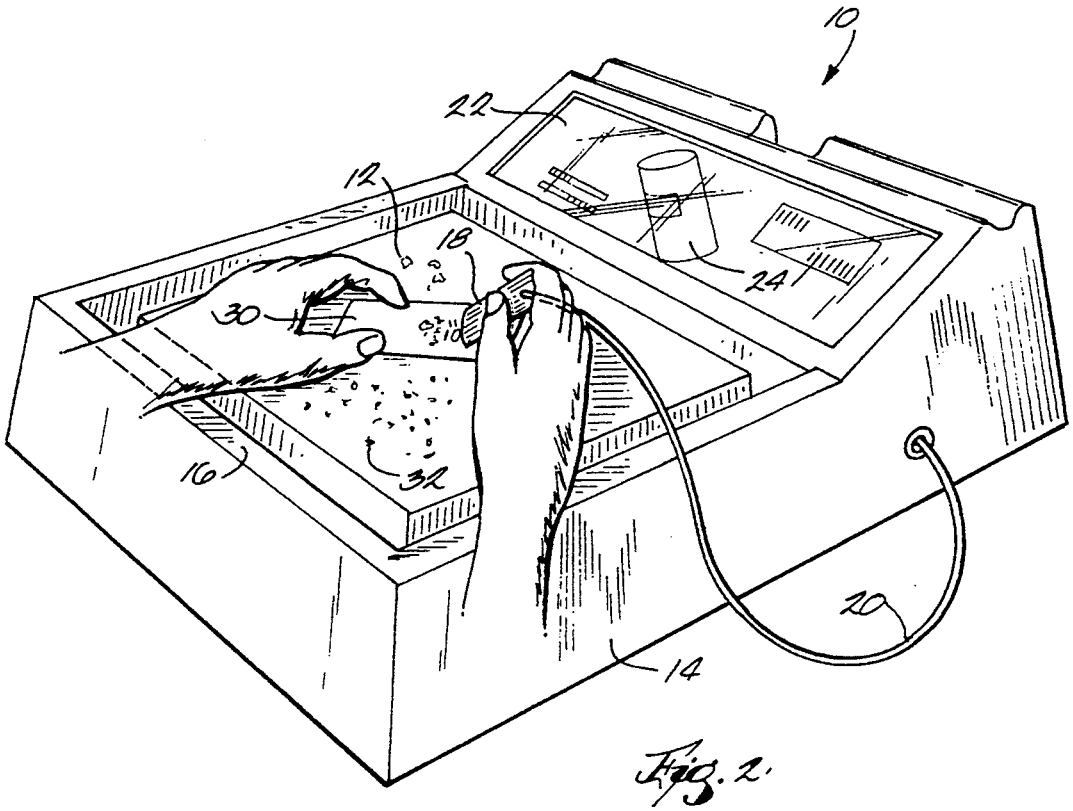
FIG. 2 is a perspective view of the device of FIG. 1 showing an advertising display during illumination and illustrating the use of the device during scratching of a lottery ticket.
Figures 3, 4, 5:
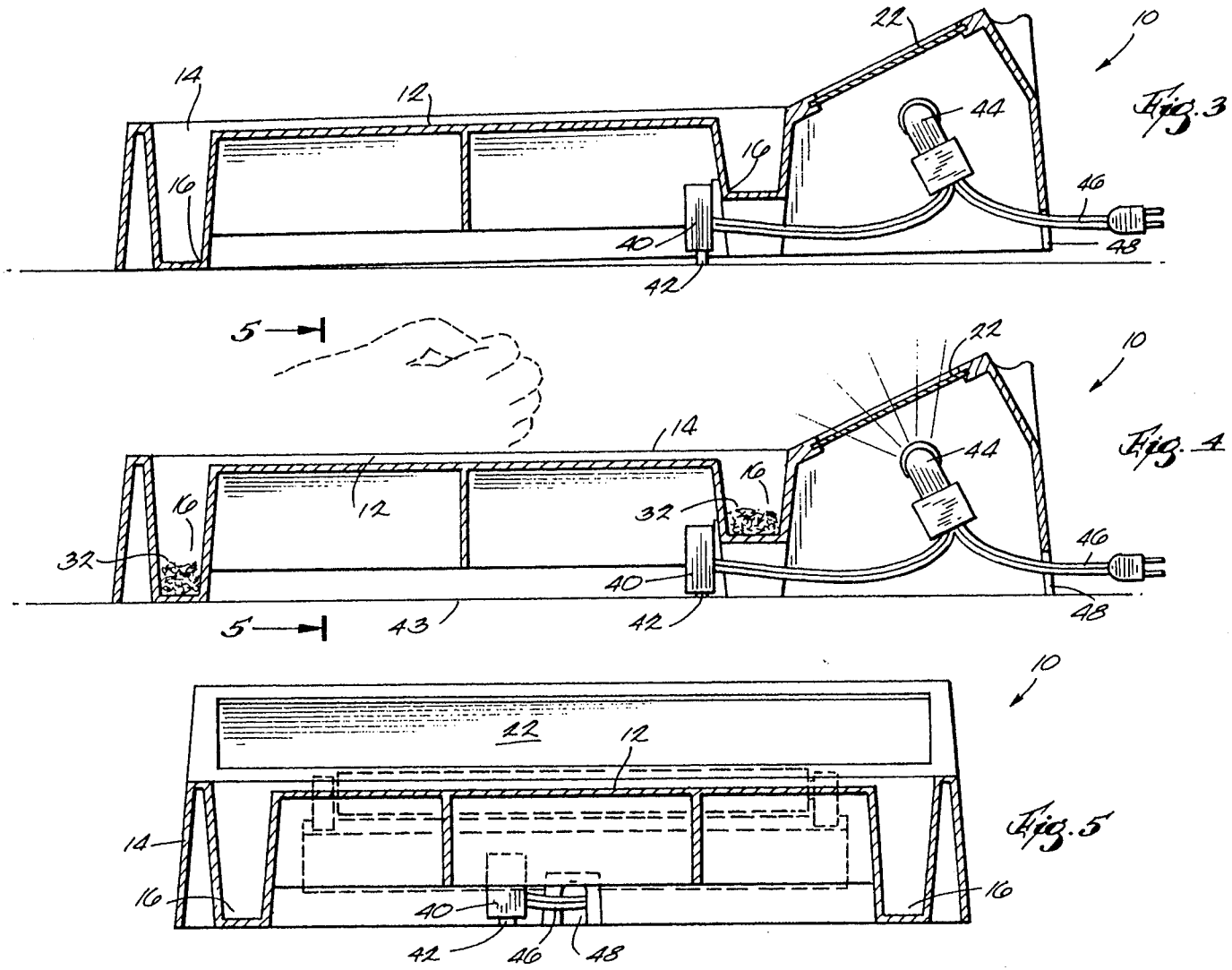
FIG. 3 is a central side elevational cross-sectional view of the device shown in FIG. 1.
FIG. 4 is a cross-sectional view as shown in FIG. 3 during use and illustrating an accumulation of lottery ticket scraping debris and showing the hand of the user by phantom lines.
FIG. 5 is a cross-sectional view of the device of FIG. 4 taken along line 5—5; and, FIG. 6 is a perspective view of a further embodiment of the invention with parts broken away.

Referring more particularly to the drawings, there is seen a lottery ticket scraping device of this invention 10. Device 10 includes a flat base surface 12 for supporting lottery tickets 30 during scratching thereof. In the embodiment shown, surface 12 has molded integrally therewith a surrounding housing 14 and an intermediate depression or moat 16. As best seen in FIGS. 2 and 4, residue 32 from scraping of lottery ticket 30 can be accumulated in indentation 16. A scraping device 18 can be attached to the device by means of a cord or chain 20.

An advertising surface 22 is provided for supporting advertising messages 24. Surface 22 is preferably a flat material that carries advertising information such as pictures and words on its under-surface, visible through the top surface. In one embodiment, surface 22 is translucent, carrying a message that is visible substantially only when the device is illuminated.

Referring to FIGS. 3 through 5, there is seen a switch 40 attached to the underside of housing 14 for controlling the illumination of surface 22. Knob 42 of switch 40 is spring biased in the extended position seen in FIG. 3. The device 10 is thus supported in the elevated position shown in FIG. 3 off supporting surface 43. As best seen in FIG. 4, when downward pressure is applied to surface 12, usually by the hand of a person scraping the covering material off the lottery ticket, the entire device 10 is pivoted downwardly to the right thereby depressing knob 42 and activating switch 40. This causes illumination of light 44 which is attached by means of a cord 46 to an electrical source. An opening 48 is provided in housing 14 for outward extension of cord 46. While cord 46 is shown for purposes of illustration, the light can be connected to a battery, instead.

Figure 1:
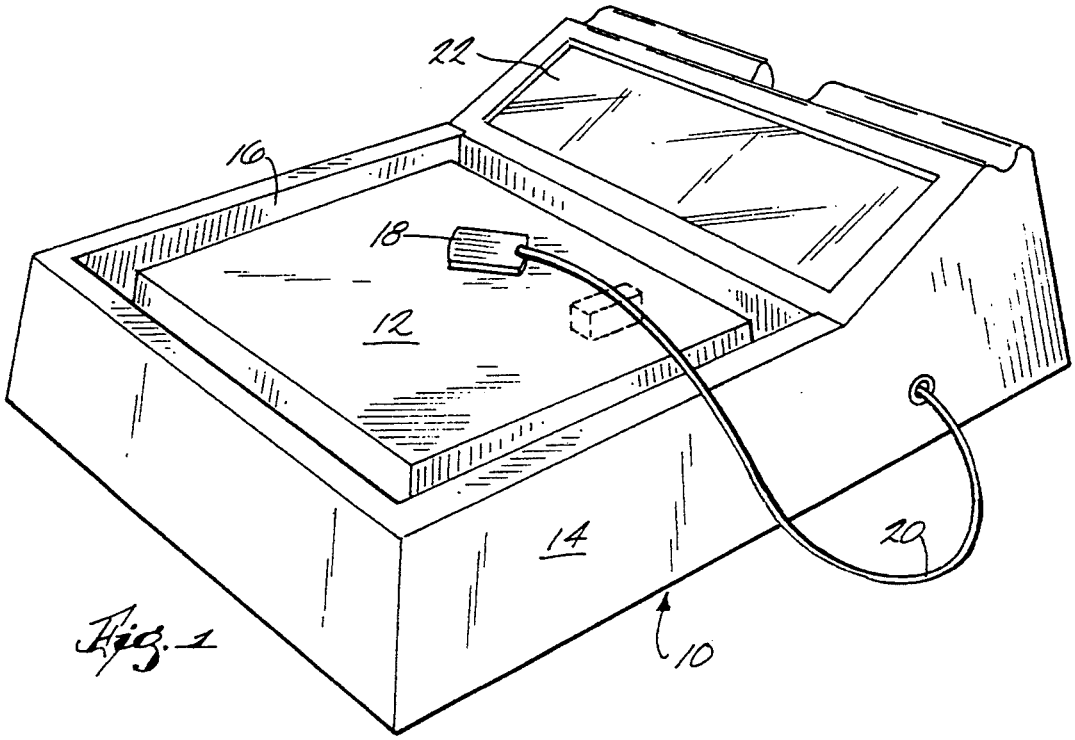
FIG. 1 is a perspective view of one embodiment of the invention.

As seen in FIG. 1, in one embodiment when the device 10 is not in use the advertising message 24 on advertising display surface 22 is not visible. However, upon illumination of light 44 the message can be viewed. It will be understood that, if desired, message 24 can be visible at all times, even when there is no internal illumination provided.

Figure 6:
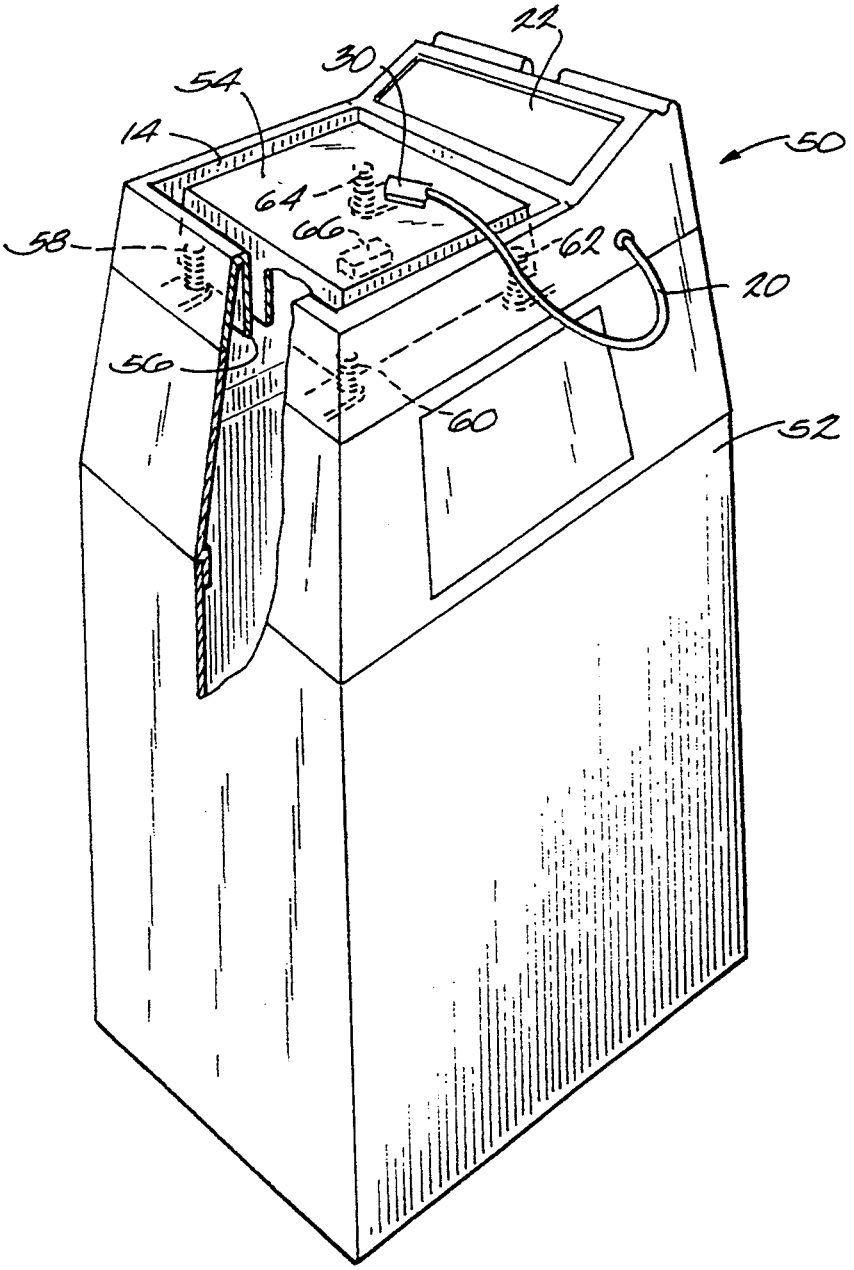

Referring to FIG. 6, there is seen a modified embodiment 50 of the invention. It will be noted that device 50, or the previously described embodiment can be fitted to form a closure on an otherwise open top of a trash receptacle 52. In this case provision is made for disposal of scrapings, spent tickets, and other debris directly into receptacle 52. Thus, a slot 56 is provided on at least one side of surface 54 to provide for such waste disposal.

In the embodiment of FIG. 6 base surface 54 is supported on each of its four corners by a biasing means such as springs 58, 60, 62, and 64. Surface 54 thus can move straight downwardly or, also, can be tilted in any direction, depending on where on surface 54 a downward pressure is applied. A switch 66 is closed by any such downward movements of surface 54 to activate a battery or otherwise electrically powered light similar to that shown in FIGS. 4 and 5.

While the apparatus hereinbefore described is effectively adapted to fulfill the aforesaid objects, it is to be understood that the invention is not intended to be limited to the specific preferred embodiment of lottery ticket scrapings catcher set forth above. Rather, it is to be taken as including all reasonable equivalents within the scope of the following claims.

What is claimed is:

1. A lottery ticket scratch device comprising:

a smooth base surface for supporting lottery tickets for scratching off of a coating therefrom, said surface being supported in a housing by biasing means in a normally elevated position, an indentation in the base surface adjacent at least one side of said base surface for receiving residue from spent lottery tickets, an advertising display mounted on said device, means for illuminating said advertising display, a switch activated by depression of said base surface for activating said illuminating means.

2. A device according to claim 1 wherein said indentation is adjacent to at least three sides of said surface.

3. A device according to claim 1 wherein said base surface is pivotally mounted in said housing so that application of pressure on said surface causes one side thereof to be pivoted downwardly.

4. A device according to claim 3 wherein said switch is carried by said downwardly pivotal side of said base surface.

5. A device according to claim 1 wherein a lottery ticket scratching device is attached to said housing.

6. A device for use in connection with scraping coatings from lottery tickets, said device comprising:

a base surface mounted in a housing, said base surface supporting lottery tickets for scraping off said coating therefrom;

an advertising display mounted on said housing;

means for bringing said advertising display into view upon use of the device, including means for illuminating said advertising display, said illuminating means activated only upon use of the device; and an indentation in said base surface, surrounding said base surface on at least three sides, for catching said scraped coatings.

7. A device as recited in claim 6 wherein said illuminating means includes a switch activated by depression of said base surface, and a light source for illuminating said advertising display upon closure of said switch.

8. A device according to claim 7 wherein said base surface is pivotally mounted in said housing so that application of pressure on said surface causes one side thereof to be pivoted downwardly, causing closure of said switch.

9. A device according to claim 8 wherein a lottery ticket scratching device is attached to said housing.

10. A device according to claim 7 wherein all four corners of said base surface are supported by a biasing means so that pressure applied to any point on said surface will cause closure of said switch.

11. A lottery ticket scratch device comprising:

a smooth base surface for supporting lottery tickets for scratching off of a coating therefrom, said surface being supported by biasing means in a normally elevated position, means adjacent said base surface for receiving residue from spent lottery tickets, an advertising display mounted on said device, means for illuminating said advertising display, a switch activated by depression of said base surface for activating said illuminating means;

said device mounted as a closure over the top of a trash receptacle and wherein a slot is provided adjacent to the base surface for disposing of waste materials into said receptacle.

* * * * *